United States Patent [19]

Nakamura et al.

[11] 4,260,127

[45] Apr. 7, 1981

[54] YOKE FOR USE IN CONCRETE WORK

[76] Inventors: Masazo Nakamura, 50, Higashino-cho, Daihoji-machi, Minami-ku, Osaka-shi, Osaka-fu; Eiichi Sudo, 20-15, 2-chome, Nishikoiwa, Edogawa-ku, Tokyo-to; Kiyoshi Urata, 13-11, 2-chome, Shinden, Ichikawa-shi, Chiba-ken, all of Japan

[21] Appl. No.: 105,738

[22] Filed: Dec. 19, 1979

[30] Foreign Application Priority Data

Oct. 19, 1979 [JP] Japan ..... 54-147168[U]
Oct. 19, 1979 [JP] Japan ..... 54-147169[U]

[51] Int. Cl.[3] ..... B28B 7/00

[52] U.S. Cl. ..... 249/207; 249/188; 249/219 R

[58] Field of Search ..... 249/13, 18, 26, 27, 249/33, 48, 49, 50, 194, 219 R, 158, 155, 187 R, 188, 205, 207, 210; 425/DIG. 105

[56] References Cited

U.S. PATENT DOCUMENTS

| | | | |
|---|---|---|---|
| 1,300,436 | 4/1919 | McKay | 249/219 R X |
| 3,350,049 | 10/1967 | Reiland | 249/48 |
| 3,751,196 | 8/1973 | Cannon et al. | 249/48 X |

*Primary Examiner*—J. Howard Flint, Jr.
*Attorney, Agent, or Firm*—Wenderoth, Lind & Ponack

[57] ABSTRACT

A yoke for use in concrete work comprising a tubular body having a square section and provided with a longitudinal groove on the external surface of each side of the tubular body. The tubular body is filled with foamed plastics over the whole or only in both end portions of the bore thereof.

5 Claims, 7 Drawing Figures

YOKE FOR USE IN CONCRETE WORK

SUMMARY AND BACKGROUND OF THE INVENTION

The present invention relates to a yoke for use in construction work, and more particularly to a yoke used to clamp the side shutters in concrete work.

Conventional yokes for this purpose are made of steel and have square sections. Because these yokes produce a tremendous noise when they bump against a hard object, they are unfit for use in construction work at night in a residential area. In addition, because both ends of these yokes are open, fresh concrete is apt to flow into the yokes and set therein. An increase in weight caused by this concrete is frequently undesirable.

It is an object of the present invention to provide a yoke which obviates the above-described disadvantages.

BRIEF DESCRIPTION OF THE DRAWINGS

With this object in view and as will become apparent from the following detailed description, the present invention will be more clearly understood in connection with the accompanying drawings, in which.

DETAILED DESCRIPTION OF THE INVENTION

Figure 1:
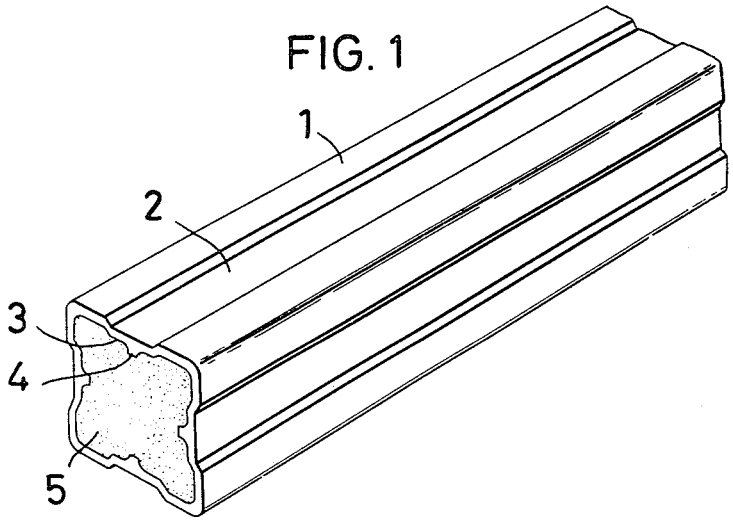
FIG. 1 is a perspective view of a yoke according to the present invention.
Figure 2:
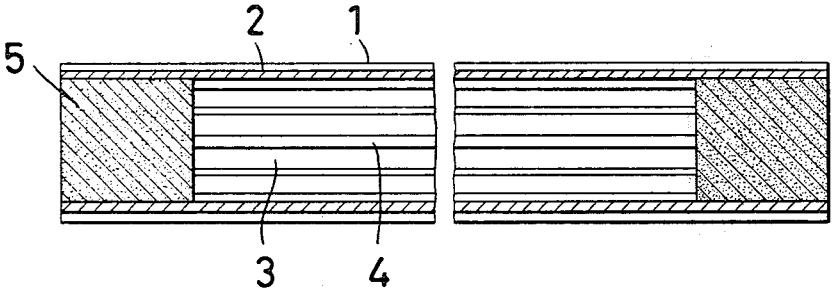
FIG. 2 is a fragmentary sectional view thereof.

Referring now to FIGS. 1 and 2, a yoke in accordance with the present invention is made of aluminum and has a square section. A longitudinal groove 2 is provided on the external surface of each side 1 of the yoke for the purpose of reinforcement. The portion of the internal surface of each side 1 which corresponds to the longitudinal groove 2 is formed into a longitudinal protuberance 3. A longitudinal rib 4 is formed along the center line of the longitudinal protuberance 3.

Either the whole or only both end portions of the bore of the yoke are filled with foamed plastic 5. The foamed plastic 5 may be molded beforehand so as to fit the internal surface of the yoke. In the alternative, plastic in a liquid state may be put into the bore of the yoke and then heated so that the plastic may be foamed and expanded until it fits the internal surface of the yoke.

The first embodiment described above is bound to the side shutter by means of wires or the like.

Figure 3:
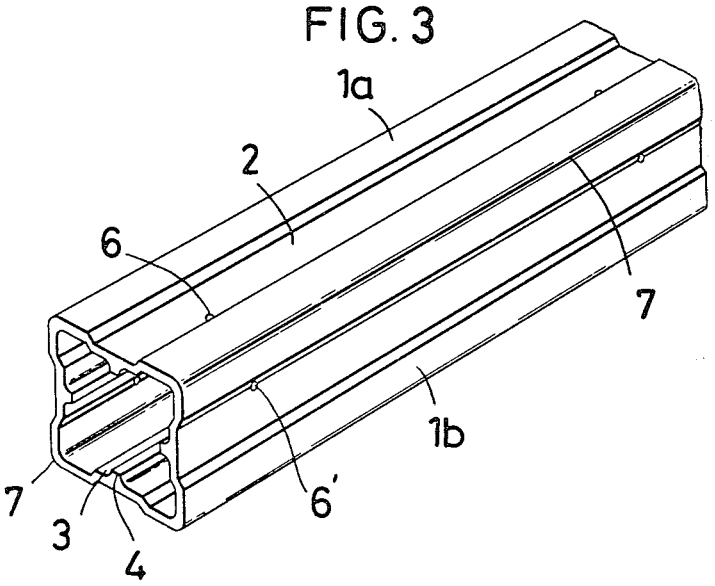
FIG. 3 is a perspective view of another embodiment of the present invention.
Figure 4:
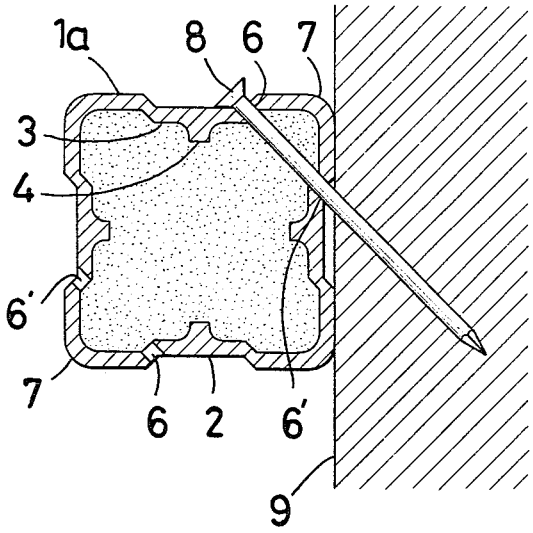
FIG. 4 is an enlarged sectional view thereof, illustrating how the yoke is fixed to the side shutter.

The second embodiment shown in FIGS. 3 and 4 is structurally the same as that of the first embodiment except that by way of an additional feature it is provided with several pairs of holes 6 and 6' for nails. The hole 6, which is one of the two holes constituting each pair, is provided in a side 1*a* of the yoke, while the hole 6', which is the other of the two holes, is provided in a side 1*b* of the yoke which is perpendicular to the side 1*a*. The axis of the hole 6 is in alignment with the axis of the hole 6', and the common axis of the holes 6 and 6' makes an angle of about 45° with the sides 1*a* and 1*b* of the yoke. The holes 6 and 6' are arranged at regular intervals along the length of the yoke, and each pair of holes 6 and 6' are adapted to receive a nail 8 for fixing the yoke to the side shutter 9.

Figure 5:
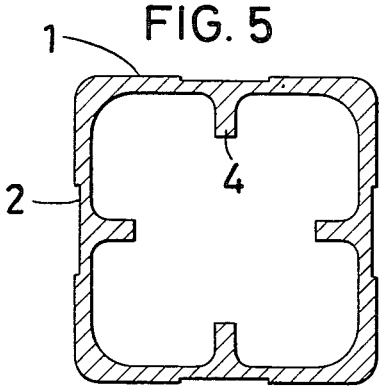
FIGS. 5 to 7 are transverse cross sectional views of other embodiments.
Figure 6:
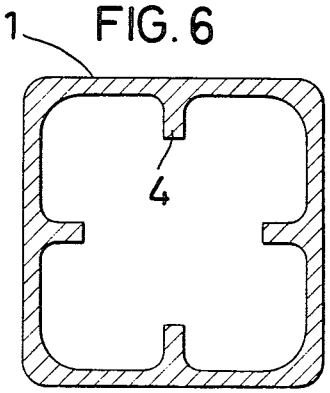
Figure 7:
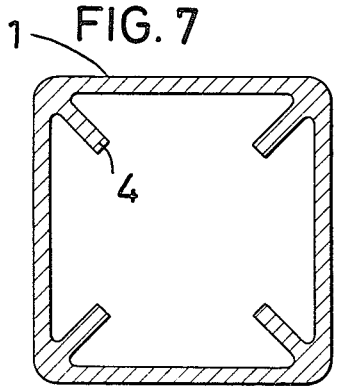

Referring to FIGS. 5 to 7, modified forms of the yoke are shown, having different transverse cross sections from those shown in FIGS. 1 and 3.

The yoke in accordance with the present invention serves for the prevention of noise because a noise produced by the bumping against a hard object is absorbed by the foamed plastics 5.

The yoke in accordance with the present invention has another advantage that the foamed plastic 5 prevents fresh concrete from flowing into the yoke.

The yoke in accordance with the present invention has still another advantage that the foamed plastic 5 per se is so light that it does not increase the weight of the yoke appreciably.

The second embodiment of the present invention has an advantage that the holes 6 and 6' secure efficiency in fixing the yoke to the side shutter 9.

While we have disclosed two embodiments of the present invention, it is to be understood that they have been described by way of examples only, various other modifications being obvious.

What I claim is:

1. A yoke for use in concrete work comprising a tubular body having a square section and provided with a longitudinal groove on the external surface of each side of said tubular body, said tubular body being filled with foamed plastic in at least both end portions of the bore thereof.

2. A yoke as set forth in claim 1, wherein the portion of the internal surface of each side of said tubular body which corresponds to the longitudinal groove on the external surface thereof is formed into a longitudinal protuberance.

3. A yoke as set forth in claim 2, wherein a longitudinal rib is formed along the center line of said longitudinal protuberance.

4. A yoke as set forth in claim 1, wherein said tubular body is provided with a plurality of pairs of holes in two sides of said tubular body which are perpendicular to each other, the axes of each pair of holes being in alignment with each other and making an angle of 45° with the sides of said tubular body.

5. A yoke as set forth in claim 1, wherein said tubular body is made of aluminum.

* * * * *